United States Patent [19]

Curry et al.

[11] 4,139,965

[45] Feb. 20, 1979

[54] DEVICE USING COATED PAPER AND CHEMICAL REACTIVE MARKER

[75] Inventors: Beverly J. Curry, Huntington Beach; Alan R. Pitkanen, Manhattan Beach; Gary M. Saffer, Torrance; Robert G. Trout, Huntington Beach, all of Calif.

[73] Assignee: Mattel, Inc., Hawthorne, Calif.

[21] Appl. No.: 832,457

[22] Filed: Sep. 12, 1977

[51] Int. Cl.[2] ..... A63H 33/00

[52] U.S. Cl. ..... 46/1 R; 46/226; 35/9 G; 35/26; 427/333

[58] Field of Search ..... 35/9 G, 36, 66, 26; 46/226, 228, 1 R; 427/333, 260

[56] References Cited

U.S. PATENT DOCUMENTS

| | | | |
|---|---|---|---|
| 1,509,872 | 9/1924 | Murray | 427/261 |
| 2,826,511 | 3/1958 | Messinger | 428/420 |
| 3,079,271 | 2/1963 | Kranz | 427/333 X |
| 3,454,344 | 7/1969 | Ryan et al. | 35/9 G X |
| 3,585,735 | 8/1968 | Miller | 35/66 |
| 3,617,325 | 11/1971 | Spokes | 35/66 X |
| 3,745,672 | 7/1973 | Duskin | 35/9 G X |
| 3,800,441 | 4/1974 | Macpherson | 35/26 |
| 3,864,684 | 2/1975 | Shimuzu | 427/333 X |

*Primary Examiner*—Louis G. Mancene
*Assistant Examiner*—Mickey Yu
*Attorney, Agent, or Firm*—John G. Mesaros; Max E. Shirk; Ronald M. Goldman

[57] ABSTRACT

In a device using an impregnated paper with a chemically reactive marker, the device includes a box-like housing having a translucent planar surface with light projected from within the box onto the rear side of the surface. A paper impregnated with an indicator dye resulting in an opaque paper is placed on the surface. Marker pens having substance chemically reactive with the indicator dye are used to mark the paper. The chemical reaction between the marker solution and the coating renders the so-marked areas translucent for passage of light through the paper in the region so-marked. Transparent dyes are utilized in the markers to combine with the color of the indicator dye to form a third color which is a combination of the two colors.

11 Claims, 3 Drawing Figures

DEVICE USING COATED PAPER AND CHEMICAL REACTIVE MARKER

BACKGROUND OF THE INVENTION

The background of the invention will be discussed in two parts:

1. Field of the Invention

This invention relates to toys, and more particularly to a toy device utilizing an impregnated paper and a chemically reactive marker for drawing thereon.

2. Description of the Prior Art

Toys or games utilizing a writing surface in conjunction with a marker wherein one or both items have suitable color activating means are shown and described in U.S. Pat. Nos. 3,454,344 and 3,826,499. In the first of the two referenced patents a writing surface colored by a pH sensitive dye has invisible markings applied thereto by a suitable writing instrument which is not pH sensitive, the writing instrument preferably having the same color as the surface. The marking of the writing instrument provides a shield to the so-marked surface, whereby upon application of a solution of a given pH, the color of the writing surface changes in the unshielded areas due to a shift in the pH range due to the chemical reaction of the solution in the writing instrument with the solution of the surface.

U.S. Pat. No. 3,826,499 illustrates a game device which includes defined areas having different invisible ink markings whereby the marking of one of said areas by a player with a color changing chemical marking means provides a differing game-scoring response from the marking of the other area. Marking sheets are used which can be treated with a suitable acid or base material which remains substantially invisible with the writing instrument being provided with appropriate color changing chemical materials.

Both devices simply employ a sheet of paper suitably treated in conjunction with a chemically reactive solution which may be handled or carried in a felt tip marker pen or in a sponge or the like. In one device, a wax crayon is utilized to shield certain portions of the treated paper so that upon application of the chemically reactive solution to the paper the wax coated portions protect the paper solution.

Such devices are generally not suitable for children of tender years. Pre-school children and children in the early grades are, however, fond of coloring books and the like. Furthermore, such children are fascinated with unusual effects.

Accordingly, it is an object of this invention to provide a new and improved device utilizing chemically reactive writing surfaces and markers.

It is another object of this invention to utilize an impregnated paper having an opaque quality in conjunction with a lighted surface.

It is a further object of this invention to provide a new and improved toy having an illuminated surface for retaining an opaque treated paper for use in conjunction with markers having chemically reactive solutions rendering the opaque paper translucent in differing colors upon marking.

SUMMARY OF THE INVENTION

The foregoing and other objects of the invention are accomplished by providing a box-like housing having a light source therein for lighting a translucent planar surface upon which is affixed a sheet of paper impregnated with an indicator dye solution selected from a group which renders the paper substantially opaque. Such dyes include bromocresol purple; bromocresol green and ethyl bis (2,4, dinitrophenyl) acetate. The indicator dye is a dark color at a given pH and a different color at a different, usually lower pH. Marker pens are provided and include a felt tip for conveying a mild citric acit solution mixed with translucent or transparent dyes to the surface of the marker. The chemical reaction between the solution carried by the markers and the compound with which the paper is impregnated shifts the pH to render the paper translucent in the area so-marked in a color determined by the color combining of the transparent dye with the indicator dye.

The concentrations of the solutions utilized in both the markers and paper are selected to provide a time delay between the application of the marker solution to the paper and the appearance of the color on the paper to provide a ghost-like glowing effect.

Other objects, features and advantages of the invention will become apparent upon a reading of the specification when taken in conjunction with the drawings in which like reference numerals refer to like elements in the several views.

DESCRIPTION OF THE PREFERRED EMBODIMENT

Briefly, the present invention includes a light box having a housing and a planar surface of generally rectangular form which is light transmitting or translucent for being suitably illuminated by light means within the housing projecting on the rear side thereof. A suitable writing surface or substrate such as paper having the same overall rectangular configuration as the planar surface, is impregnated or chemically treated with an indicator dye of a given generally dark color which renders the paper opaque. With the paper placed on the planar surface and with the light means illuminated, the light is substantially blocked. A number of marker pens of the felt tip type are provided, with each of the marker pens containing a mild solution chemically reactive with the indicator dye to shift the pH thereof to provide a different color. The marker pens also include transparent dyes, each pen having a different transparent or translucent dye of a color which, when combined with the different color of the indicating dye at a given pH generates a third color upon application to the paper, which third color is the color combination resulting from the mixing of the color of the indicator dye at a given pH with the transparent dye of the marker. The strength of the solution used for the impregnation by the indicator dye and the strength of the solution used for the markers is so selected that a time delay results between the time of application and the time of appearance of the third color giving a ghostly effect to the device. The so-treated papers may also be provided with outlined portions similar to a coloring book sheet to provide delineated portions of pictures within which a child may apply different colors, much as in the manner of a conventional coloring book. When the marker solution is applied to the coated paper, the so-marked areas are rendered translucent to permit the passage of light through the so-marked areas in the color resulting from the combination of the two dyes to provide a delayed action glowing quality or iridescence to the so-colored picture.

Figure 1:
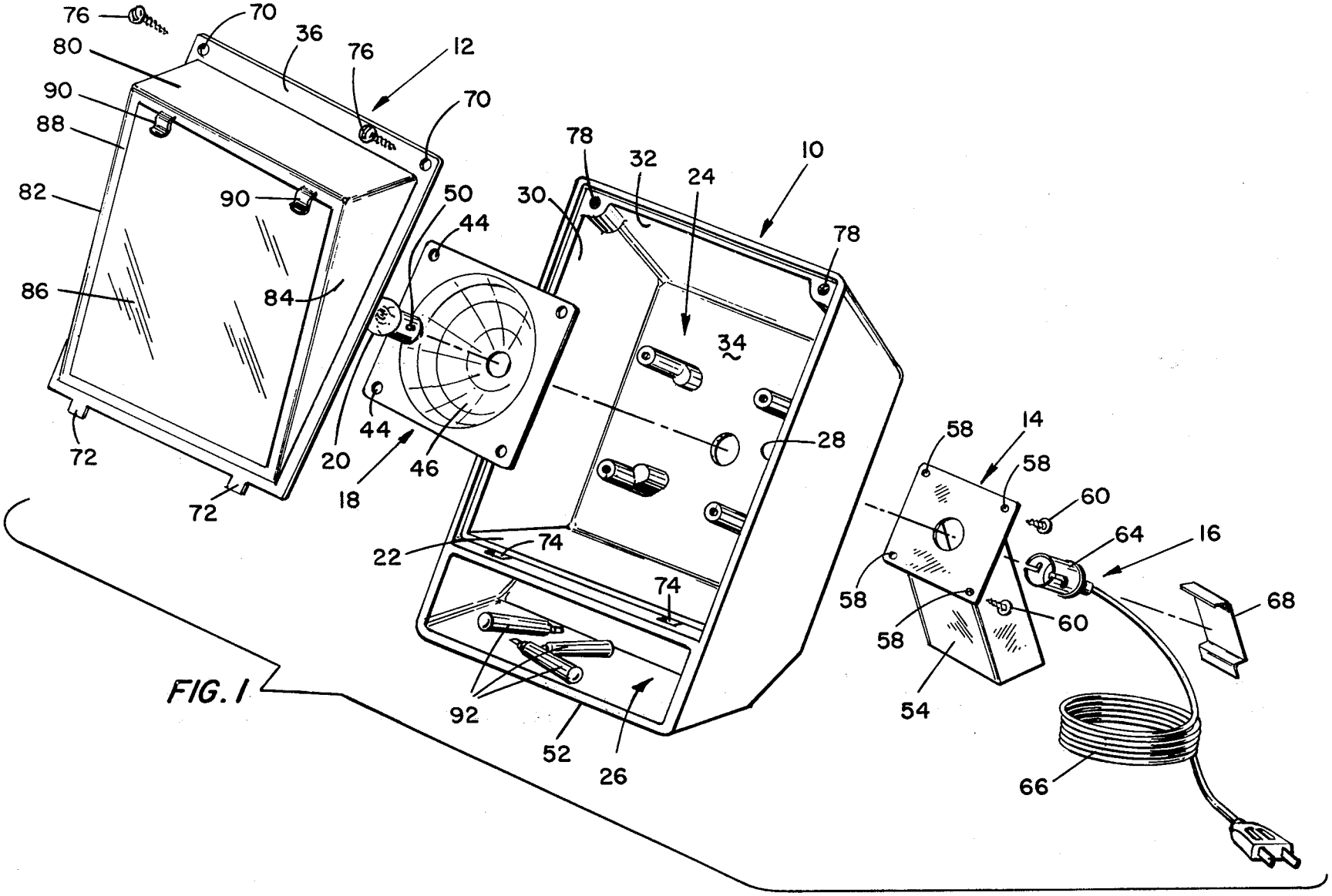
FIG. 1 is an exploded perspective view of the housing of the light box according to the invention.
Figure 2:
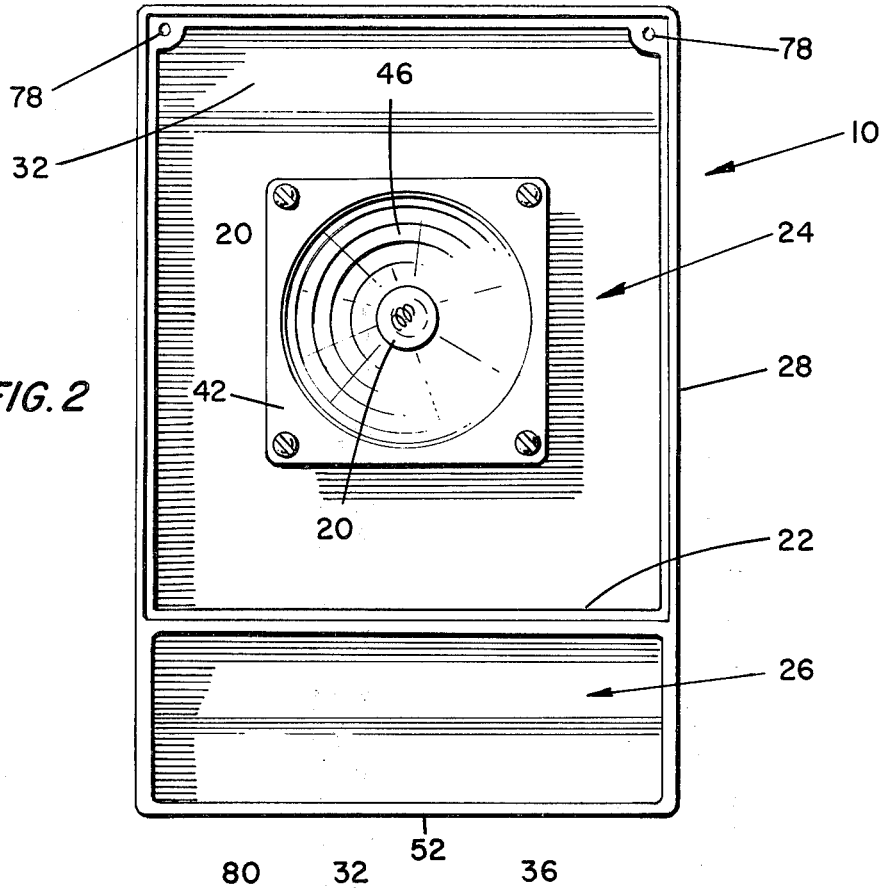
FIG. 2 is a front view of the housing of FIG. 1 with the cover thereof removed.

Referring now to the drawings and particularly to FIGS. 1 and 2, there is shown a light box including a housing generally designated 10, a cover member generally designated 12, a lamp retainer and support assembly generally designated 14, a lamp socket assembly generally designated 16, a reflector generally designated 18 and a lamp 20.

The housing 10 is generally box-like with the interior thereof being generally rectangular in form with a transversely extending wall 22 dividing the interior into a lamp compartment 24 and a smaller storage compartment 26. The lamp compartment 24 has a generally rectangular opening defined by the dividing wall 22, opposing sidewall portions 28 and 30, the top wall 32 and the rear wall 34, the edges of these walls being generally planar and adapted to receive the generally planar peripheral flange 36 of cover member 12 in abutting relation to close the lamp compartment 24.

Formed integrally with the rear wall 34, on the interior of lamp compartment 24, are a plurality of posts 38, the locations of which generally define the corners of a square which have centrally located with respect thereto an aperture 40 extending through the rear wall 34. The reflector member 18 has a peripheral flange portion 42 which is generally square in outer configuration with apertures 44 at each of the corners thereof, the apertures 44 being aligned with apertures in the free ends of posts 38 for the passage of suitable fastening means such as screws therethrough to retain the reflector member 18 within the lamp compartment 24. The reflector 18 has a dished portion 46, which may be generally spherical or parabolic in form with a suitable reflective high gloss surface. Centrally disposed with respect to the dished portion 46 an aperture 48 is in alignment with aperture 40 for receiving the base 50 of the lamp 20 therethrough.

The housing 10 is adapted to be supported at an angle to a supporting surface and the lower wall 52 thereof is at an angle to the plane of the front opening. A support member 54 is generally rectangular in cross section and is provided with a generally rectangular plate member 56 having apertures 58 at the four corners thereof for passage of screws 60 therethrough to engage apertures (not shown) in the rear surface of rear wall 34 to secure the support member 54 to housing 10. The plate 56 is provided with an aperture 62 which is in alignment with aperture 40. Suitably inserted through aperture 62 and aperture 40 is a lamp socket 64 of the bayonet type and into which is inserted the base 50 of the lamp 20. The socket 64 is suitably connected to an electrical cord 66 and clamped within support member 54 by means of a suitable clamp member 68. The lower edge of support member 54 is angularly formed to be in a common plane with the bottom wall 52 of housing 10 when the light box is assembled.

The cover 12 has a peripheral flange 36 with apertures 70 in each of the upper corners thereof with a pair of downwardly depending tabs 72 on the opposite edge, the tabs 72 being adapted to engage matingly configured apertures 74 formed in the forward edge of dividing wall 22. With the tabs 72 engaging apertures 74 the cover 12 is then secured to the opening of lamp compartment 24 by passage of screws 76 through apertures 70 and into apertures 78 formed on the interior of the two upper corners of lamp compartment 24 to thereby secure the cover 12 to the housing 10. The housing 10 may be formed of a substantially opaque plastic material and is substantially light-tight with the cover 12 affixed thereto.

Extending outwardly from the peripheral flange 36 of cover 12, the cover 12 includes an upper wall 80 of generally rectangular configuration with opposing sidewalls 82 and 84 of triangular configuration connected to upper wall 80. The cover member 12 is closed by a planar surface 86 interconnecting the edges of upper wall 80 and sidewalls 82 and 84. In the assembled position, although the housing 10 is inclined at some angle, the configuration of cover member 12 permits the planar surface 86 to be either vertical or at a slight inclination to the surface supporting the housing 10. The planar surface 86 can be conveniently provided with a peripheral ridge 88 which defines a rectangular surface of approximately the same dimension as the paper to be used with the device. The planar surface 86 may be integral with the cover member 12 or separate therefrom and attached thereto, but in any event it is at least partially light transmitting or translucent in quality and sufficiently rigid to support the paper thereon while the markers are being applied thereto. The cover member 12 is provided with a pair of retaining clips 90 adjacent the upper edge of peripheral ridge 88 of planar surface 86 and suitably spaced for the insertion and retention of paper onto the planar surface 86. If desired, the entire cover member 12 can be made of a translucent material and with the walls 80, 82 and 84 generally perpendicular to the palne of the planar surface 86, the passage of light through the sidewalls will enable the child to detect that the lamp 20 is illuminated when the surface 86 is covered with an opaque sheet of paper.

Figure 3:
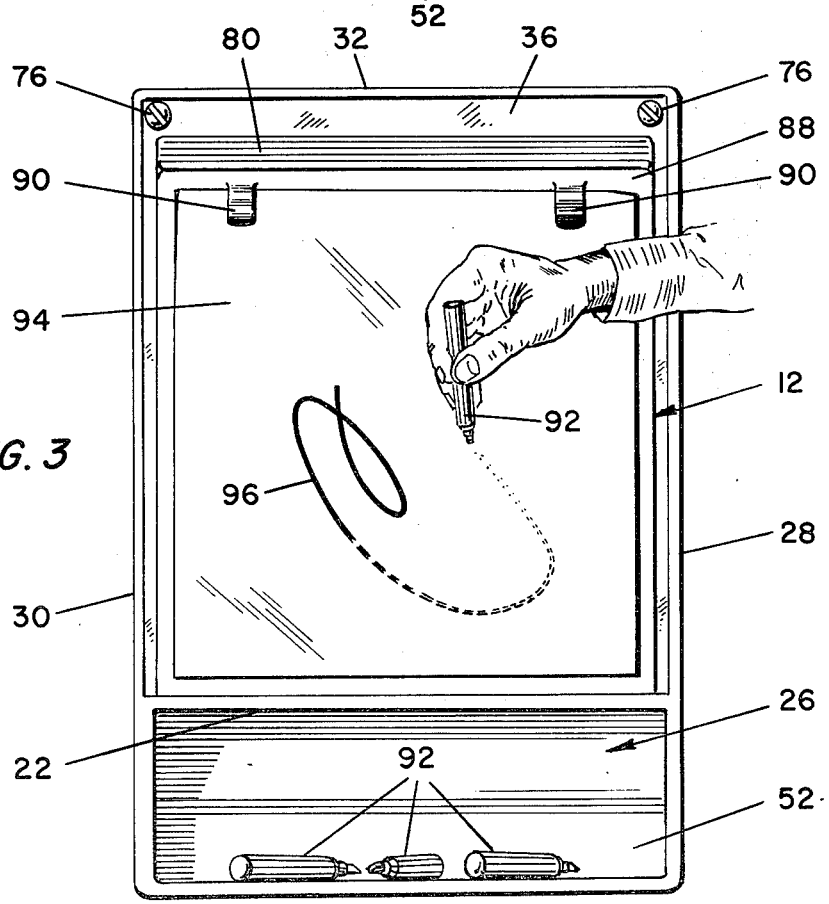
FIG. 3 is a view similar to FIG. 2 with the cover in place and coated paper being marked.

Suitable markers 92 are provided, with markers 92 being of the water-based pen or felt tip marker type. As shown in FIG. 3, the cover member 12 is in place and a sheet of impregnated paper 94 having an overall configuration substantially equal to the planar surface 86 is suitably retained thereon by retaining clips 90. A marker 92 is being used to apply a mark 96 on the paper 94. The mark 96 is shown in solid lines with a dotted line tracing continuing to the tip of the marker 92, diagramatically illustrating the time delay characteristic of the appearance of the marker 92 as it is applied.

The paper 94 consists of a 20 lb. bond paper with a pH of approximately 7.1, on which black outlined pictures may be printed. The paper is then impregnated with a solution, by weight, of 49% water, 1% sodium hydroxide pellets, 48% alcohol and 2% bromoscresol purple indicator dye. This solution is a dark purple and when applied to the paper, makes the paper essentially opaque.

The markers 92 are of the felt tip marker type, the marker pens being filled with a 5% citric acid solution which reacts with the sodium hydroxide on the paper. With the citric acid solution alone, upon chemically reacting with the sodium hydroxide, the sodium hydroxide is neutralized resulting in the bromocresol purple changing color from dark purple to light yellow. Bromocresol purple is dark purple at a pH of over 6.8 and light yellow at a pH of under 5.2. To form other colors, each of the markers 92, in addition to being filled with a 5% citric acid solution, has a different color transparent dye added in small amounts, the translucent dye color being selected to combine with the light yellow to form the desired color. A blue dye in the marker, when applied to the paper results in a green color; a red dye results in an orange color; and a combination of blue and red dye results in a brown color.

The resulting colors on the paper 94 produced by the citric acid and dye solution in the marker pens are considerably lighter than the dark purple of the paper 94. Thus, the so-marked written on areas of the paper 94 become translucent to the light and the colors appear to glow. The speed with which the color change and "glowing" effect takes place is mostly dependent on the concentration of sodium hydroxide at that depth. In summary, the impregnating solution includes a percentage of sodium hydroxide combined with an indicator dye, the indicator dye being selected from the group of available indicator dyes which would render the paper substantially opaque upon application to a substrate, such as bond paper. In addition to bromocresol purple, the group includes bromocresol green which is blue green above a pH of 5.4 and yellow below a pH of 3.8; and ethyl bis (2,4-dinitrophenyl) acetate which is blue above a pH of 9.6 and colorless below a pH of 8.4. The paper chosen for impregnation has a pH of 7.1 while normal paper has a pH of 5.6, the selection of the higher pH paper prividing more stability for the impregnated paper product. The solution utilized in the marker pens is a mild acid solution which chemically reacts with the sodium hydroxide at a rate dependent upon the concentration of the solutions and the depth of impregnation thereof to render the so-marked on areas translucent to the light therethrough resulting in a glowing effect. Different colors are obtained by adding to the mild acid solution of the marker pens transparent dyes which color combine with the pH shifted color of the selected indicator dye to produce third colors which are combinations of the colors utilized in the indicator dye and the transparent dyes. In the embodiment described, bromocresol purple has been selected for the indicator dye to render the paper opaque with a mild citric acid solution being utilized to neutralize or chemically react with the sodium hydroxide of the coating. Marker pens have the solution thereof combined with different transparent dyes to provide other colors.

With a picture outline on the coated paper 94 and the paper 94 inserted on the planar surface 86 of the light box by means of retaining clips 90, with the lamp 20 illuminated, initially the opaque quality of the paper 94 will prevent the transmission of light from the lamp 20 through the surface 86 and through the paper 94. As a marker 92 is utilized to trace a mark 96 on the paper 94 (as depicted in FIG. 3) the mark 96 will commence appearing after some time delay in a color determined by the particular felt tip marker 92 which is utilized. As the citric acid solution of the marker 92 reacts with the sodium hydroxide of the paper 94, the areas of the paper 94 written on or marked on to form the mark 96 will become light transmitting or translucent thereby enabling the light from lamp 20 to pass through the translucent planar surface 86 and through the areas of the paper 94 on which the mark 96 has been formed. If the outline of the picture formed on the paper 94 is "colored" the overall appearance will be of an illuminated colored picture appearing on an opaque background, the opaque background being that area in which the markers have not been used. Additionally, depending upon the concentration of the solutions used, a time delay will exist between the application of the solution from the marker 92 to the paper 94 before the colors start to appear thereby giving an illusion of "magic" to the drawing.

Although the description hereinabove proceeds with reference to impregnation of paper, any convenient substrate can be initially treated with an indicator dye to produce the results described and the invention is not indended to be limited to paper as a medium. While there has been shown and described a preferred embodiment, it is to be understood that various other adaptations and modifications may be made within the spirit and scope of the invention.

What is claimed is:

1. In a toy, the combination comprising:

a generally hollow housing having a generally planar at least partially light transmitting surface;

means within said housing for projecting light onto the rear side of said planar surface;

chemically treated substrate means for mounting on the front side of said planar surface, the chemical treatment including a chemical compound rendering said substrate means substantially opaque; and marking means having a chemical compound for reacting with the chemical treatment on said substrate means for rendering the so-marked areas of said substrate means translucent to permit the light from said light means to pass through said substrate means.

2. The combination according to claim 1 wherein the compound for treating said substrate means includes an indicator dye providing a normally dark color on said substrate means, the chemical compound of said marking means reacting therewith for providing a different color in the so-marked areas of said substrate means.

3. The combination according to claim 2 wherein said marking means further include at least partially light transmitting dyes which will combine with said different color of said indicator dye to provide other colors.

4. The combination according to claim 3 wherein said marking means include a plurality of marker pens.

5. The combination according to claim 4 wherein said indicator dye is selected from the group consisting of: bromocresol purple; bromocresol green; and ethyl bis (2,4-dinitrophenyl) acetate.

6. The combination according to claim 5 wherein the compound for treating said substrate means includes a substantial percentage by weight of water and alcohol, with smaller percentages of said indicator dye and sodium hydroxide pellets.

7. The combination according to claim 6 wherein the compound for treating said substrate means consists of, by weight, approximately 49% water, approximately 48% alcohol, approximately 2% indicator dye, and approximately 1% sodium hydroxide pellets.

8. The combination according to claim 7 wherein the chemical compound in said marker pens includes a mild citric acid solution.

9. The combination according to claim 8 wherein the citric acid solution is a 5% concentration.

10. The combination according to claim 9 wherein said substrate means is paper.

11. The combination according to claim 10 wherein said paper has a pH of 7.1 and said indicator dye is bromocresol purple.

* * * * *